US007980720B2

(12) United States Patent
Shemwell et al.

(10) Patent No.: US 7,980,720 B2
(45) **Date of Patent: *Jul. 19, 2011**

(54) LED DAZZLER SHIELD

(75) Inventors: David M. Shemwell, Newcastle, WA (US); Weihao Alexander Long, Kirkland, WA (US); Michael Perry Challeneger, Bothell, WA (US); Robert Lee Fuhriman, Jr., Bothell, WA (US); Donald Limuti, Kirkland, WA (US)

(73) Assignee: Stellar Photonics, LLC, Bellevue, WA (US)

( * ) Notice: Subject to any disclaimer, the term of this patent is extended or adjusted under 35 U.S.C. 154(b) by 147 days.

This patent is subject to a terminal disclaimer.

(21) Appl. No.: 12/454,300

(22) Filed: May 14, 2009

(65) Prior Publication Data

US 2009/0284957 A1 Nov. 19, 2009

Related U.S. Application Data

(63) Continuation-in-part of application No. 12/152,539, filed on May 15, 2008, now Pat. No. 7,794,102.

(51) Int. Cl.
*F21V 33/00* (2006.01)

(52) U.S. Cl. ..... 362/109; 362/114

(58) Field of Classification Search ..... 362/109, 362/114, 184, 545, 112; 42/1.28; 361/232; 434/11

See application file for complete search history.

(56) References Cited

U.S. PATENT DOCUMENTS

| | | | | |
|---|---|---|---|---|
| 7,040,780 | B2 | 5/2006 | Diehl | |
| 7,794,102 | B2 * | 9/2010 | Shemwell et al. | 362/109 |
| 2006/0234191 | A1 | 10/2006 | Ludman | |

* cited by examiner

*Primary Examiner* — Ali Alavi
(74) *Attorney, Agent, or Firm* — Anthony Claiborne

(57) ABSTRACT

A shield produces a "dazzling" effect: disorientation and temporary and fully reversible blindness in subjects for the purpose of threat deterrence. The apparatus is comprised of a plurality of light emitting diodes (LEDs) capable of intense illumination. Light emitted by each LED is further pulsed and focused by reflective optics to produce a dazzling effect. The shield further provides ballistic protection, chemical or electrical crowd control functionality, safety-glass breaking capability, optically propagated communications and an arm strap to further secure the shield.

12 Claims, 9 Drawing Sheets

LED DAZZLER SHIELD

CROSS-REFERENCE TO RELATED APPLICATIONS

This application is a continuation-in-part of U.S. patent application Ser. No. 12/152,539, titled "LED DAZZLER", filed May 15, 2008.

BACKGROUND OF THE INVENTION

1. Field of the Invention

This invention relates generally to systems of light sources and more particularly to non-lethal weapon systems comprised of light-emitting diodes for dazzling or stunning humans.

2. Description of the Related Art

In both civilian law enforcement and military action, it is often necessary for enforcers to render a hostile opponent harmless without causing death or permanent injury permanent injury to the subject. Such non-lethal threat deterrence employed at present includes high-voltage electrical weaponry sold under the trademark Taser®, high-pressure water jets or water cannons, and aerosol or gas dispersed chemical irritants such as CN and CS tear gases, pepper-spray, and the like. Each of the forgoing methods for non-lethal threat deterrence has significant shortcomings.

While Tasers are routinely employed in domestic civilian law enforcement to subdue individual opponents, because the operation of a standard Taser projects a wired electrical connection between a voltage source (typically part of the Taser apparatus held by he user) and the dart propelled into the skin of the subject, it is not well suited to crowd control situations with more than a few subjects. Further, Tasers have a limited range, nominally on the order of 32 feet, rendering them unsuitable for subduing more distant subjects.

Furthermore, while Tasers and related electro-shock weapons are not technically considered lethal, some governmental authorities as well as some non-governmental organizations question the safety of the use of Tasers. Yet further some civilian organizations, such as Amnesty International, allege that the use of these weapons is inhumane and unethical and call for a moratorium on their use until further research establishes that they may be safely and humanely deployed.

There are serious safety concerns about the use of water cannon for riot control as well. A modern water cannon can produce streams of water at extremely high water pressures (up to 435 pounds per square inch), which is capable of breaking subject's bones and causing significant injury to internal organs such as the spleen. Further, in much of the free world the use of such weapons has negative associations with official oppression because of their extensive employment in suppressing unarmed civil rights protesters both in the United States and abroad.

Tear gases and related irritants are typically administered to subjects by dispersal as a gas or aerosol into the surroundings of the subjects. Such wide dispersal agents cause irritation and pain to the subject's eyes, respiratory system and skin, inducing the subject to leave the area of dispersal. Because the use of dispersed irritants causes pain in the subjects, it is regarded by some organizations as inhumane and unethical. Further, some evidence exists that prolonged exposure to such chemical irritants may cause interstitial scaring in the respiratory system of subjects. Yet further, because these agents are generally dispersed into in a particular area, they are non-discriminatory in effect (causing pain to hostiles and non-hostiles alike in the affected area). And yet further, the value of chemical irritants for crowd control is limited by weather conditions, a shift in wind or heavy precipitation significantly limiting the effectiveness of such agents.

It has long been observed that brief exposure to high intensity light can have the effect of momentarily blinding a viewer after the light source is removed, so much so that the viewer can become disoriented or "dazzled". Further, it has more recently been observed that brief exposure to flashing or pulsed high intensity light enhances this dazzling effect, significantly lowering the threat posed by such a subject. Efforts heretofore made to create a dazzling effect for non-lethal threat deterrence have had mixed results.

Diehl, in U.S. Pat. No. 7,040,780, describes a laser dazzler matrix, comprised of a plurality of laser light sources to produce a plurality of illumination zones. Projecting Diehl's laser matrix at a subject viewer is said to induce dazzling in the subject. Laser dazzlers such as Diehl's require substantial power supplies to provide the current and voltage needed to power the lasers, limiting the mobility of such devices.

Diehl describes embodiments of his invention that would conform to the Maximum Permissible Exposure Limits for exposure to laser light, as set forth in ANSI Z 136.1. Notwithstanding such limits, the use of blinding laser weapons is banned by international treaty (the 1995 United Nations Protocol on Blinding Laser Weapons). The humanitarian organization, Human Rights Watch, has opposed the use of laser dazzlers generally, taking the position that even lower powered lasers have the potential to cause permanent injury and has recommended that the United States discontinue all ongoing research and development of tactical laser weapons because of their potential use as blinding antipersonnel weapons. The organization has further requested that existing prototypes of tactical laser weapon systems be destroyed. While field commanders in military action abroad have requested dazzler technology to add to their arsenal of non-lethal weaponry, in response to humanitarian concerns and controversy surrounding the safety of laser weaponry generally, the adoption of laser dazzler technology by both military forces and civilian police forces has been relatively low.

Prior application Ser. No. 12/152,539, noted above, is directed to dazzler technology based on light-emitting diodes (LEDs), providing non-blinding dazzling effects. Such technology can be incorporated in riot shields and other form factors for crowd control and related law enforcement and military purposes. While the dazzling effect assists in control of subjects, it is desirable to provide additional features to discourage the subject from assaulting the user and/or attempting to take control of the dazzler. It is further desirable to provide additional utility to an LED dazzler shield or similar form factor by incorporating additional functionality useful in law enforcement.

BRIEF SUMMARY OF THE INVENTION

The present invention is a shield fashioned to produce a "dazzling" effect: disorientation and temporary and fully reversible blindness in subjects for the purpose of threat deterrence, that further enhances the crowd control, user safety and utility of the invention in both civilian law enforcement and military engagements. The apparatus is comprised of a plurality of light emitting diodes (LEDs) capable of intense illumination. Light emitted by each LED is further pulsed and focused by reflective optics to produce a dazzling effect.

Embodiments of the invention further provide ballistic protection, chemical or electrical crowd control functionality, safety-glass breaking capability, and optically propagated communications.

BRIEF DESCRIPTION OF THE SEVERAL VIEWS OF THE DRAWINGS

The foregoing objects, as well as further objects, advantages, features and characteristics of the present invention, in addition to methods of operation, function of related elements of structure, and the combination of parts and economies of manufacture, will become apparent upon consideration of the following description and claims with reference to the accompanying drawings, all of which form a part of this specification, wherein like reference numerals designate corresponding parts in the various figures, and wherein:

DETAILED DESCRIPTION OF THE INVENTION

The present invention may be implemented in a number of form factors. Common to all embodiments, however, are an array of light emitting diodes driven by driver circuitry supplied with power from a power supply and operating in response to a signal source.

Figure 1:
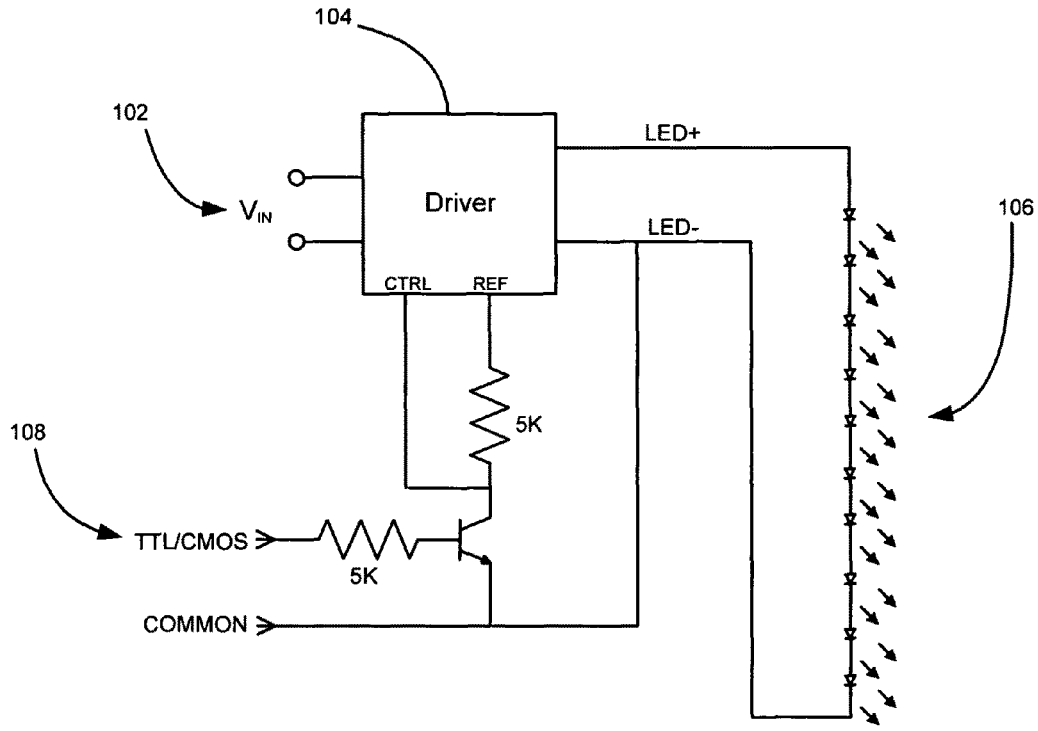
FIG. 1 is a schematic of LED driver circuitry for an embodiment of the present invention.

Turning to FIG. 1, illustrated is schematic electronic circuitry for a driver circuit powering an array of light emitting diodes. Power 102 is supplied to LED driver 104. In many applications, the dazzler device must be mobile and so typically the source of power 102 is a form of battery or fuel cell capable. It should be noted in any case that the amount of power necessary to drive an LED dazzler is considerably less than that for laser dazzlers and accordingly the power supplies for embodiments of the present invention may be much smaller and lighter than power supplies for laser based dazzlers.

In preferred embodiments, driver 104 should be pulse/strobe capable and should drive LEDs with constant current, resulting in maximized efficiency of the apparatus and service life of the LEDs. One such driver, suitable for arrays of up to 12 LEDs, is the BoostPuck 4015 of LED dynamics of Randolf, Vt. As will be appreciated by those of skill in the art, depending upon the type of LEDs employed in the array, embodiments having a larger number of LEDs may require a plurality of drivers. In the depicted embodiment, when signal source 108 provides a TTL/CMOS signal of +5V DC, driver 104 provides constant current power to LED array 106, causing LED array 106 to illuminate until signal source 108 provides a signal of +0V DC, at which time driver 104 cuts power to LED array and the LEDs cease illumination.

For the present invention, pulsed light may be more effective than a steady beam in inducing a dazzling effect. By providing a pulsed TTL/CMOS signal at source 108, the apparatus drives pulsed illumination of LED array 106. Embodiments may employ varying frequencies of pulsed light for effective dazzling. For embodiments employing the circuit depicted in FIG. 1, effective dazzling is obtained with frequency of signal source 108 varying from about 3 to about 12 hertz. For applications such as civilian crowd control, where minimizing harm to targets is of particular importance, the frequency range of 16-25 hertz should be avoided because of the higher probability of inducing photosensitive epileptic seizures in susceptible subjects viewing light pulsed in that frequency range.

LEDs employed in the present invention should produce high intensity visible radiation, typically on the order of 40 to 60 lumens per diode. Because targets may employ a narrow-band chromatic filter to reduce the dazzling effect of a monochromatic LED dazzler, it may be preferred in some embodiments to employ a plurality of LEDs emitting differing wavelengths for such applications.

Figure 2A:
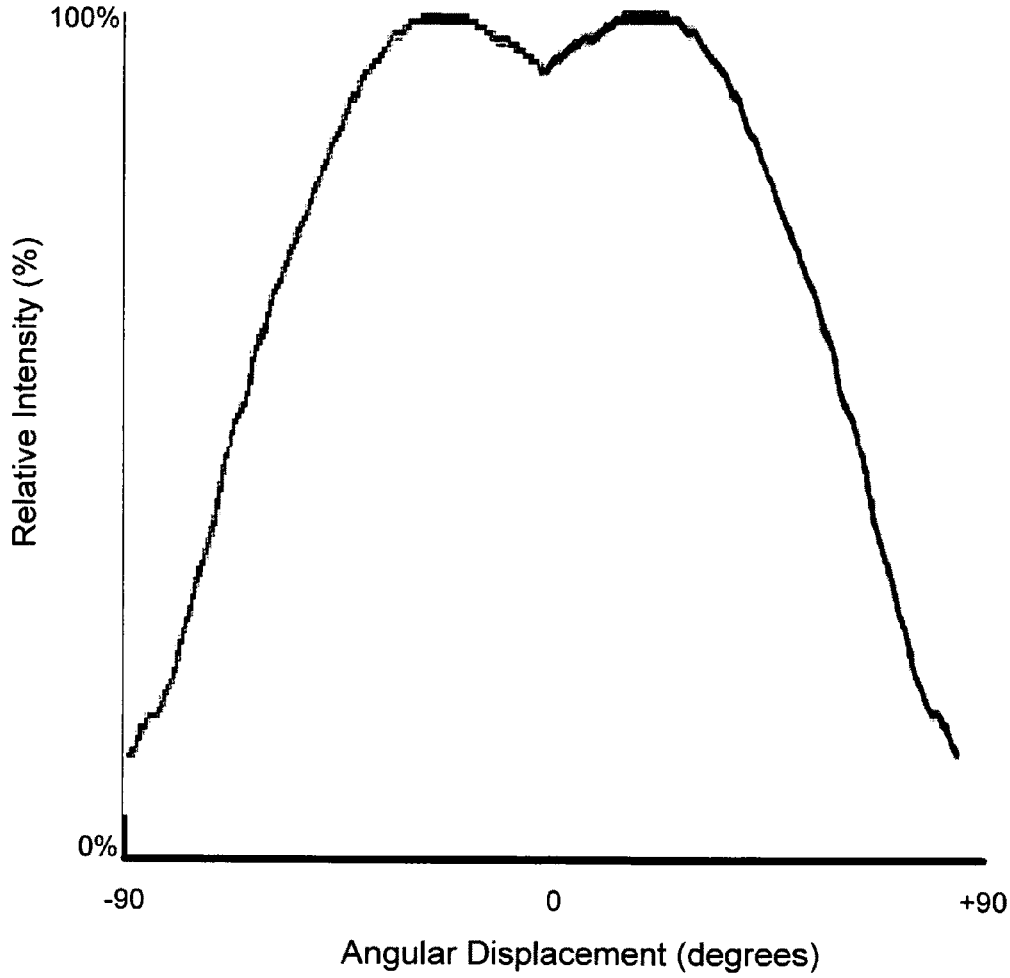
FIGS. 2*a* and 2*b* are graphs illustrating light distribution patterns for LEDs in preferred embodiments of the present invention.
Figure 2B:
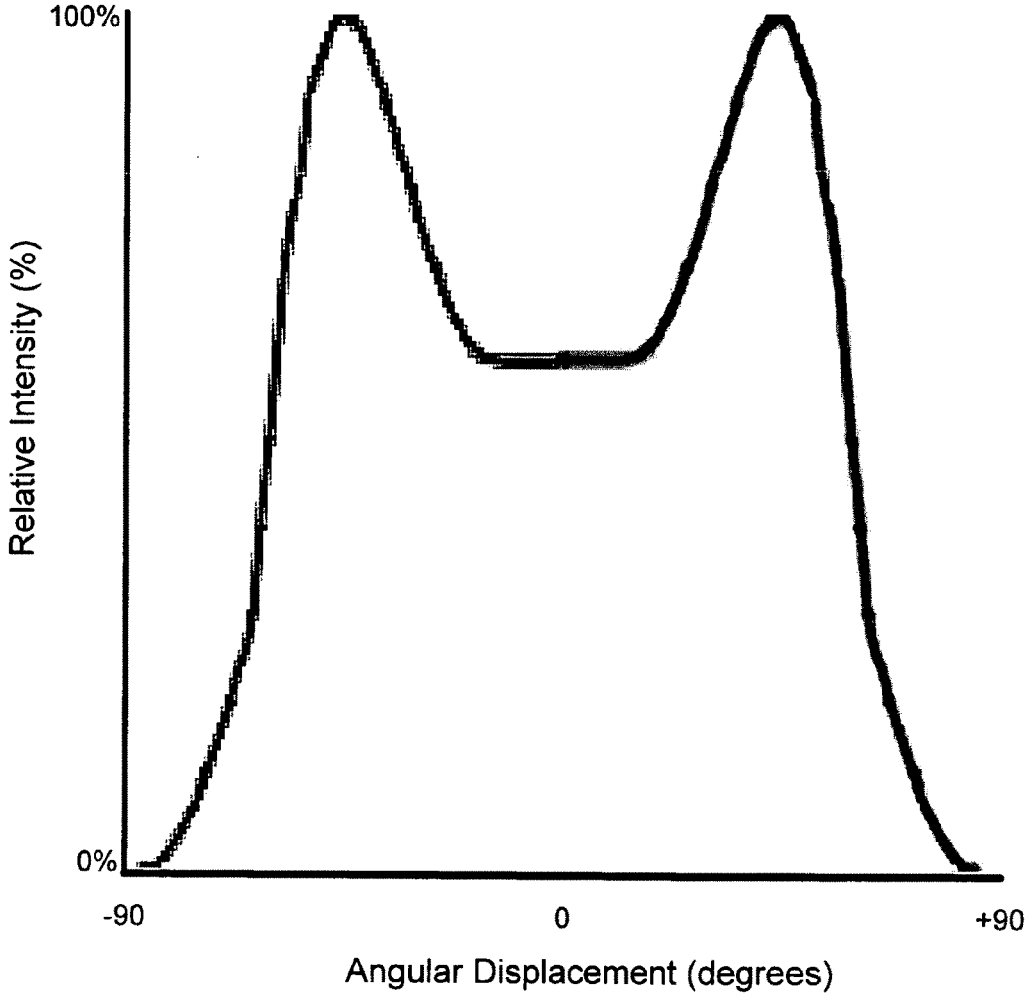

For most embodiments, the LEDs should have relatively wide light distribution patterns and no significant "cold spots" within the projection area. For such embodiments, LEDs with distribution patterns such as lambertian (FIG. 2*a*) or batwing (FIG. 2*b*) are preferred. Luxeon® LEDs, produced by Philips Lumileds Lighting Company of San Jose, Calif. are presently available with such characteristics.

The effectiveness of the LED illumination in inducing dazzling in target subjects is enhanced by appropriate optics that focus or concentrate the illumination from the LED to the target area. Depending upon the form factor of the device, the configuration of the optics for the LED dazzler may vary.

Figure 3:
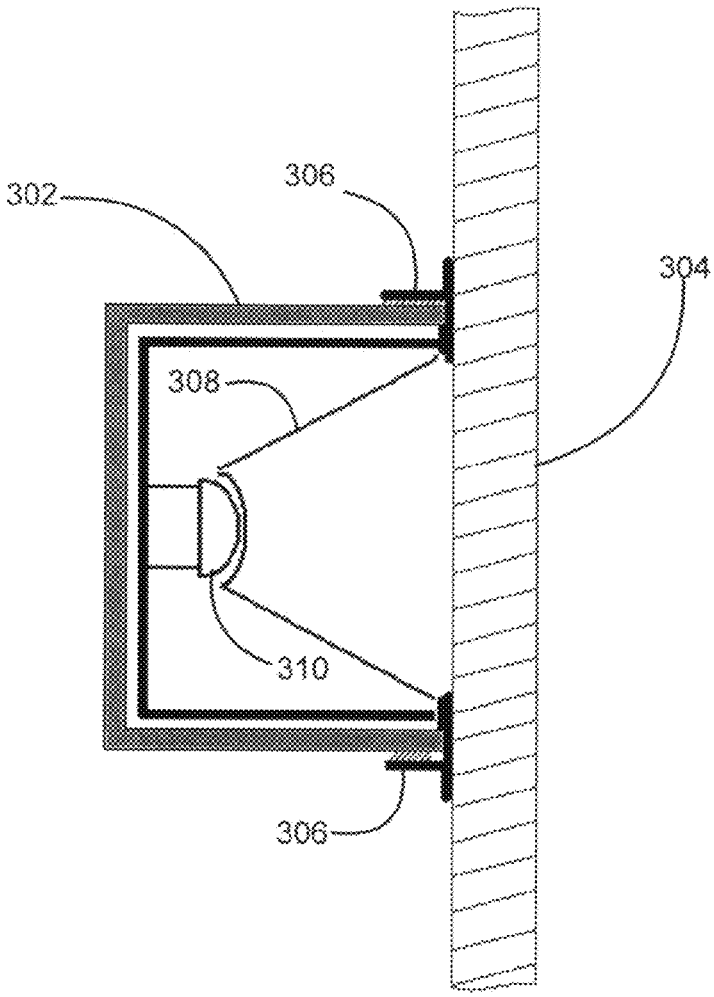
FIG. 3 is a diagrammatic representation of a cross-section of a reflector with LED according to an embodiment of the present invention.

FIG. 3 illustrates a cross section of an LED unit, comprised of cylindrical cover 302 with male threads at one end engaging female threaded annulus 306, which adheres to shield surface 304 described in more detail below in relation to FIG. 4. As will be understood by those of skill in the art, annulus 306 may be affixed to shield surface 304 in a number of ways, for example by cyanoacrylate adhesive. Cover 302 retains an LED assembly comprised of LED 310 (as discussed above in relation to FIGS. 2*a* and 2*b*) and reflector cone 308

As will be appreciated by those in the art, the embodiment depicted in FIG. 3 illustrates just one of a number of optical means that may be employed, alone or in combination, for focusing or concentrating the illumination from the LEDs. Appropriate means are selected depending upon the configuration of the dazzler and the range of the target. Such means include conical reflectors, as described above in reference to FIG. 3, along with light transmissive lenses of various configurations, as well as other refractive and reflective means to focus or collimate light, as is well known to those of skill in the optical arts. The present invention contemplates all such means.

Figure 4A:
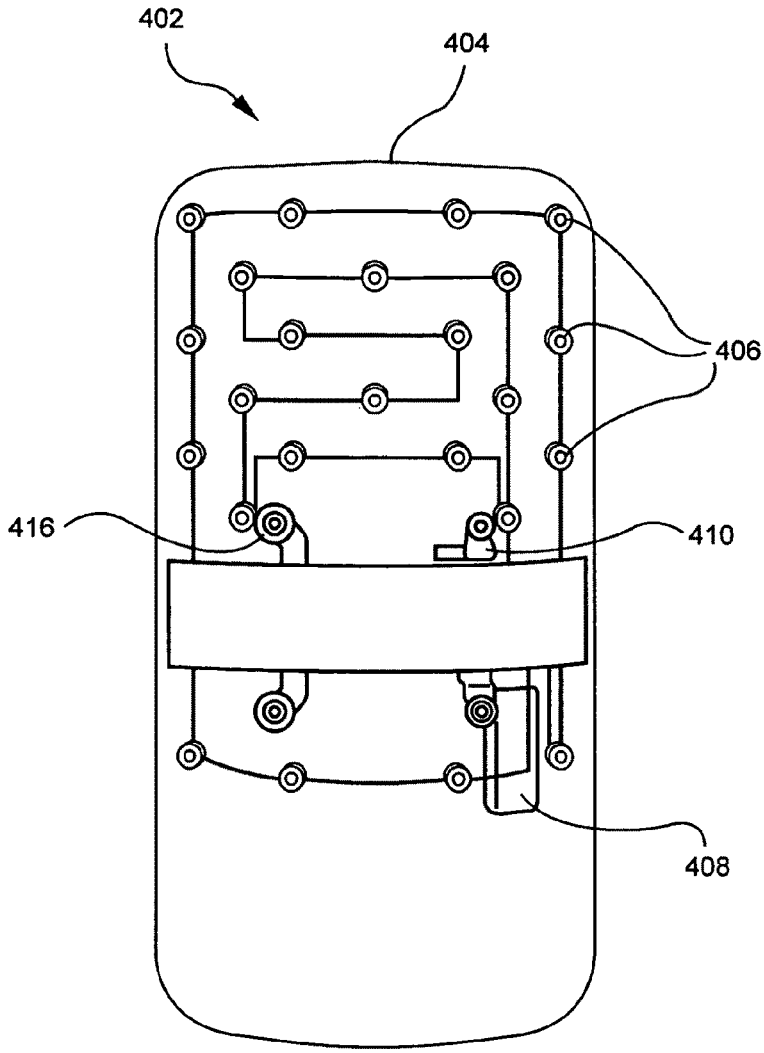
FIGS. 4*a* and 4*b* illustrate an embodiment of the present invention as a shield for military or law enforcement personnel.
Figure 4B:
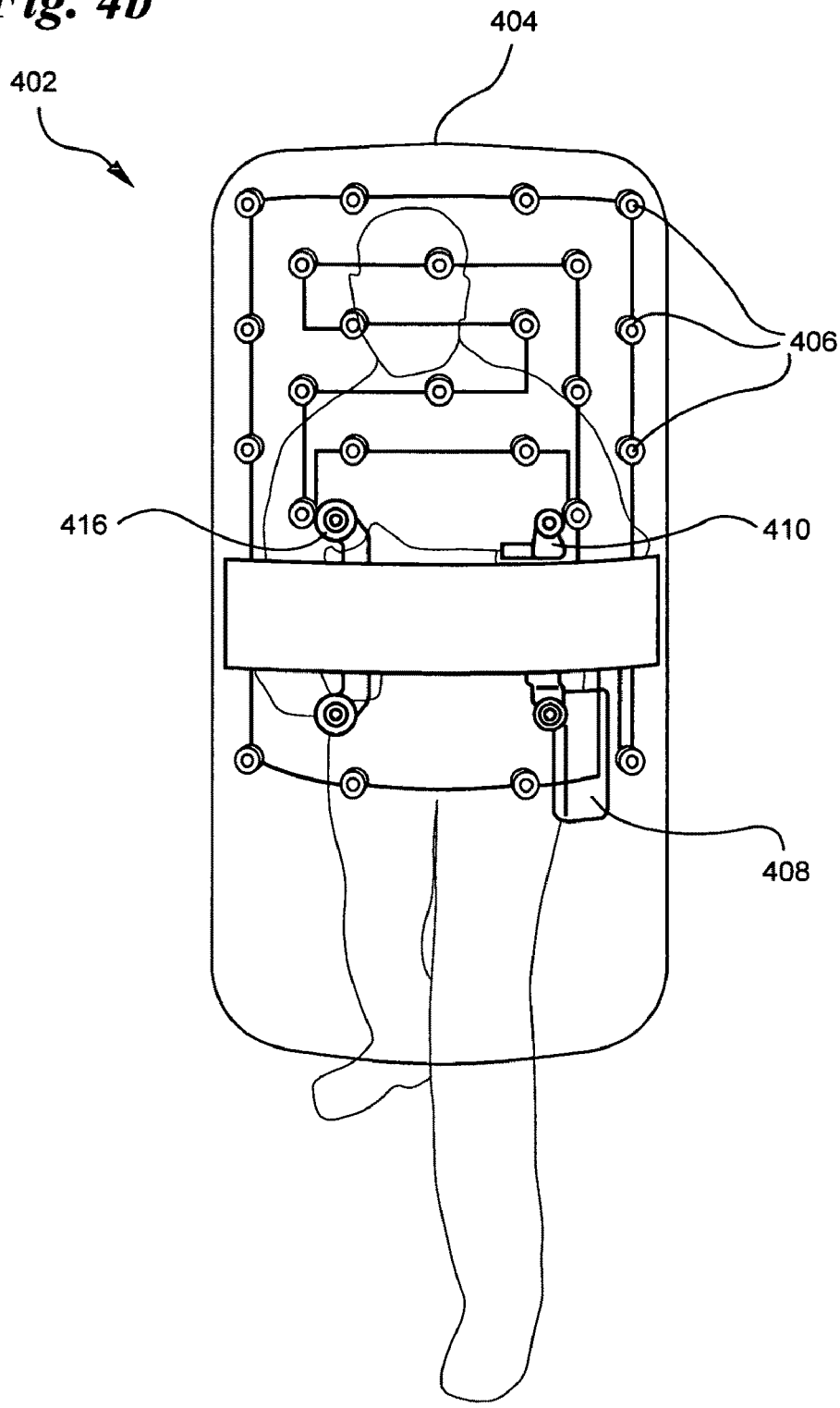

FIGS. 4*a* and 4*b* illustrate an embodiment of the invention as a shield dazzler 402. As illustrated, dazzler 402 comprises a clear shield 404 of sturdy polymer material, such as Lexan® by Saudi Basic Industries Corporation of Riyadah, Saudi Arabia, suitable for protecting the user against projectiles. Alternatively, for anti-ballistic utility when transparency is not required, shield 404 may be comprised of fabrics of strong synthetic fibers such as Kevlar® by E. I. du Pont de Nemours and Company of Wilmington Del., or other materials providing protection for the user against projectiles. Mounted on shield 404 is a plurality of LEDs 406, each LED contained in reflecting optics. When the material used for the shield is transparent, as illustrated, LED assemblies may be mounted on the user side of the shield, the light emitted by the LEDs projected through the shield. In embodiments using opaque material for the shield, LED assemblies are mounted on the side of the shield opposite the user, in the direction of dazzler subjects.

As stated above, a number of optical arrangements, such as concave reflectors or collimating lenses, will serve to concentrate and direct light emitted by LEDs 406. By way of example, the Luxeon® Star/O from Philips Lumileds Lighting Company comprises a high intensity LED with integrated optics in the form of a collimator, suitable for use in the shield dazzler as illustrated. Disposed on the user side of shield 404 and electrically connected to each LED 406 is power supply/driver circuitry 408, such as described above in reference to FIG. 1. Electrical connectivity may be provided by copper foil leads applied to the shield surface. As will be understood by those in the art, alternative means, such as conductive material painted on the shield, may be employed to provide electrical connectivity to the LEDs.

Further disposed on the user side of shield 404 are handles 410 for a user to hold dazzler 402 when in use, as illustrated in FIG. 4*b*. In the illustrated embodiment, two handles 410 are attached to shield 402 with mounting hardware 416 (in this case comprising bolts with washers and nuts). Alternatively (not illustrated), the shield may have a single handle 410 with an arm strap to mitigate the risk of a subject's wrestling the shield away from the user, as will be familiar to those of skill in the art of fabricating riot shields. In some embodiments, at least a portion of the shield's power supply/driver circuitry may be located in a handle 410 of shield 402.

Figure 5:
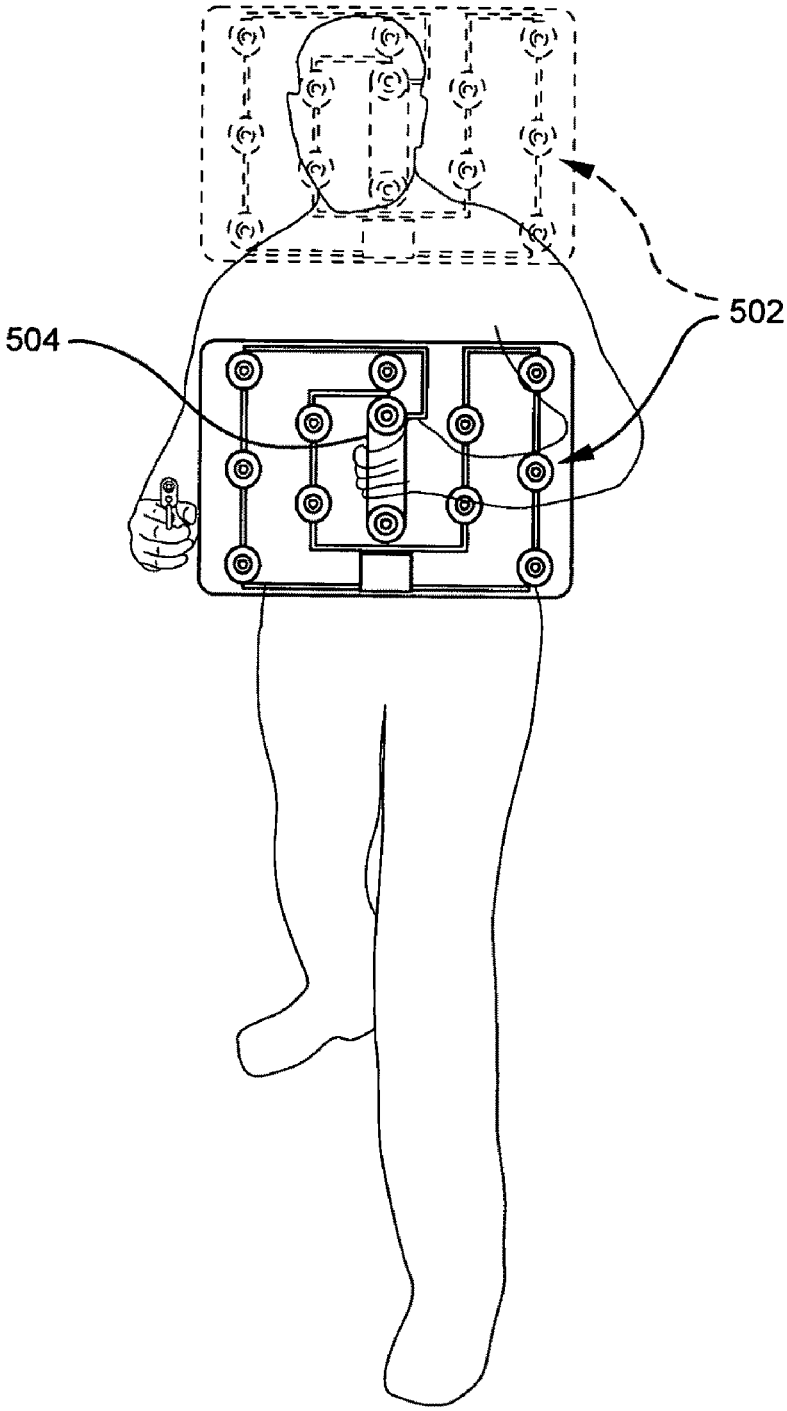
FIG. 5 illustrates an embodiment of the present invention as a smaller hand-held shield.

Shield-type dazzlers may be fashioned in a smaller form factor, as illustrated in FIG. 5, for use in applications such as law enforcement interview of persons in a vehicle, where a full shield such as illustrated in FIG. 4 would be inappropriate or difficult to maneuver.

As will be appreciated by those of skill in the art, the effectiveness of the dazzler functionality for threat deterrence can be enhanced by operation in conjunction with a high intensity directed acoustical device (HIDA), such as described in U.S. patent application Ser. No. 20050286346. The disorientation caused by viewing dazzling light is enhanced when accompanied by high intensity sound. A HIDA may also be used for communicating speech to the target. Because of these utilities, it may be preferred to incorporate a HIDA into the dazzler. Suitable HIDAs are available, for example, from American Technology Corporation of San Diego, Calif.

As will be further appreciated by those of skill in the art, while the dazzling effect assists in control of subjects, it is possible nonetheless for a subject to approach a riot shield user so closely as to be able to contact the shield, possibly wresting the shield away and/or assaulting the user. In addition to or as alternatives to HIDA technology discussed above, the dazzler device may incorporate one or more additional functionalities to discourage close proximity or contact by subjects. While some of these functionalities may present more risk of physical injury to the subject than does the dazzler alone, their employment may be required to control very disorderly or criminal civilian subjects or hostile military enemies at close range.

One such defensive functionality is the ability to disperse a lachrymal agent such as pepper spray or tear gas from the shield. In some embodiments, this functionality is provided by way of a pressurized spray canister of the agent, retained by a holder on the user's side of the shield with an aperture placed in the shield so that, when the user activates the spray, the spraying agent dispersed from the canister will pass through the aperture to the other side of the shield, in the direction of the subject. Suitable canisters of pepper gas for such purposes are available from Fox Labs of Clinton Township, Mich. As will be appreciated by those in the art, other methods of delivering lachrymal agents from the shield, such as an integrated squirt gun or aerosol pump which may be either manually or electrically operated, will provide the same utility.

Another defensive functionality is to provide the shield with the ability to administer non-lethal electrical shock to subjects. Electro-shock defense may be delivered on the surface of the shield by the placement of contacts on the subject side with an electrical potential difference between them, providing a high voltage, low amperage charge in the manner of a stun gun to discourage contact by the subject, to repulse the subject, or even to render the subject harmless. In the alternative or in addition, the shield may provide such defense by way of an integrated mechanism for aiming and propelling an electro-shock projectile (such as a Taser) at a subject in the shield's vicinity.

Yet another such defensive functionality may be provided by fabricating the subject side of the shield with sharp, elevated points. Exemplary sheet material is formed with conical points, each cone roughly 0.5 centimeters at the base and 0.5 centimeters in height, the cones arranged on a 1 to 2 centimeter square grid on the sheet, thereby presenting a surface that discourages contact by subjects.

Figure 6:
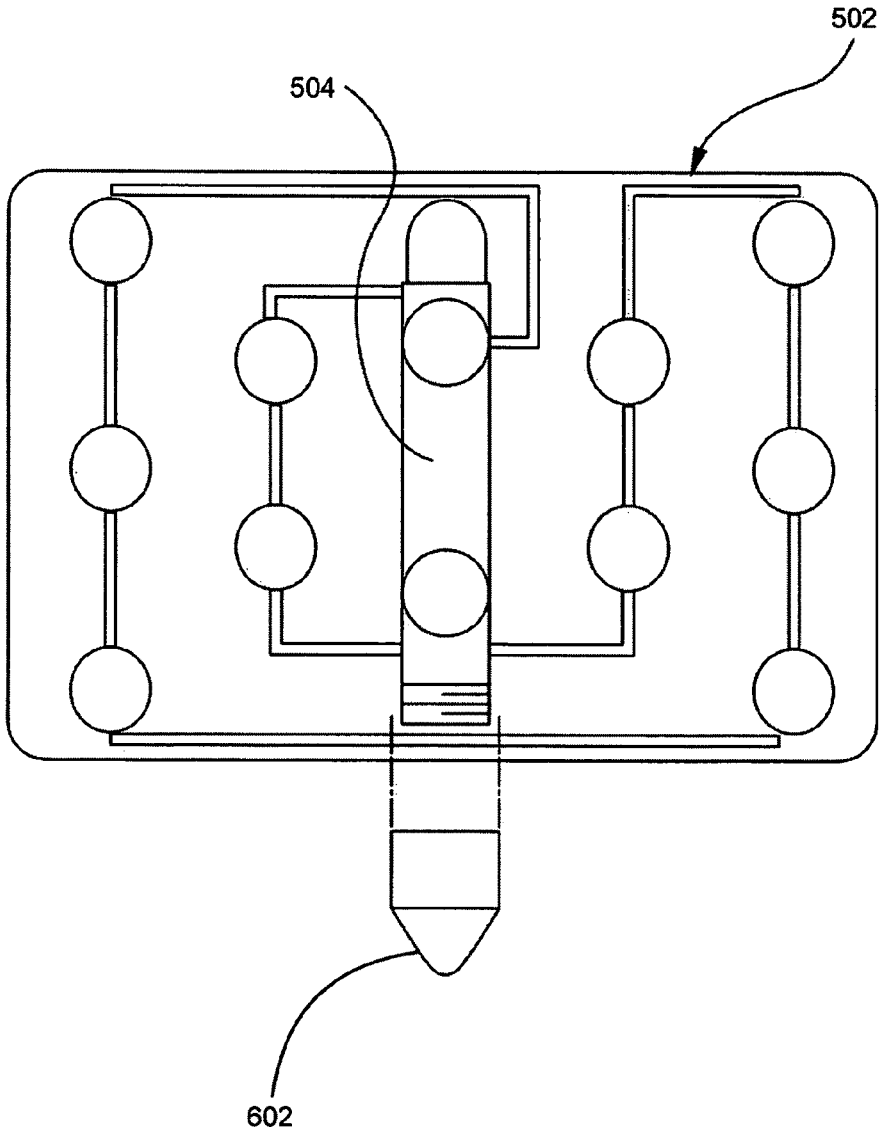
FIG. 6 illustrates an embodiment of the invention such as depicted in FIG. 5 showing an attachable glass breaker.

The shield may further provide non-defensive functionalities that are useful for law enforcement or military applications. In some embodiments, the shield may incorporate a glass breaker of carbide steel or other hard material for breaking windows to provide access for rescue and other purposes. One such embodiment provides the glass breaker as an extension to the handle of a smaller shield such as that illustrated in FIGS. 5 and 6. Shield 502 is fitted with handle 504. One end of handle 504 is threaded to receive a threaded glass breaker cap 602, such as the Bust-A-Cap manufactured by B-Safe Industries of Cumberland, R.I. As will be understood by those in the art, other embodiments (not depicted) may provide glass breaker functionality by affixing a glass breaker to the edge of the shield.

Another functionality that embodiments of the shield may provide is illumination in the manner of a flashlight. Such functionality may simply be provided by operation of shield LEDs at a constant low intensity. In the alternative, the shield may incorporate an integral conventional flashlight for operation by the user.

Figure 7A:
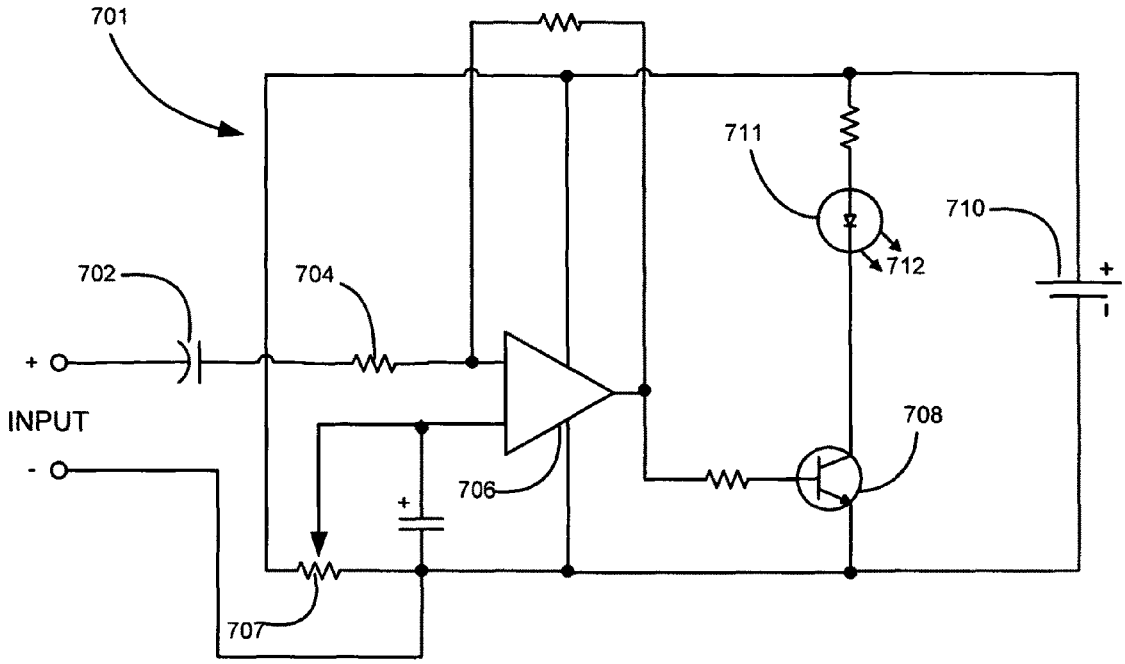
FIGS. 7*a* and 7*b* are schematics of circuitry for a light modulating transmitter and a light demodulating receiver, respectively, in embodiments of the present invention practicing light propagated communications.
Figure 7B:
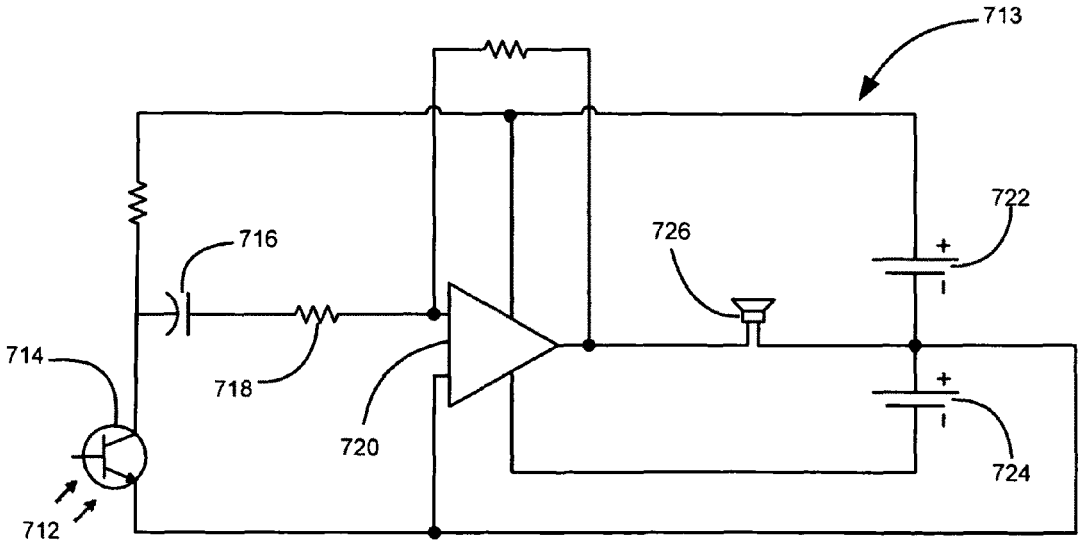

Yet another functionality that embodiments of the shield may provide is light propagated communications. In such embodiments, voice or other communication is transduced to modulate light emitted by shield LEDs for communications transmission. Modulated light communications may be received by a phototransistor or other photoelectronic device, to be demodulated and transduced for receipt by the user. FIGS. 7*a* and 7*b* illustrate circuit diagrams for an amplitude-modulated light propagated communications transmitter and receiver respectively.

Turning to FIG. 7*a*, depicting transmitter 701, input signals, such as microphone signals or other analog or digital signals, are coupled through capacitor 702 and resistor 704 to the input of operational amplifier 706, which amplifies the signals under bias control of variable resistor 707, and sends them to the base of transistor 706. Transistor 706 provides a source of variable current from power supply 710 to light emitting diode 711, thereby causing diode 711 to emit varying intensities of light 712. Accordingly, as will be clear to those of skill in the art, transmitter 701 provides light intensity amplitude modulation of input signals. As will be understood by those in the art, the source of modulated light 712 may, instead of single LED 711, comprise a portion of or the entire array of LEDs in the dazzler, with the multiple LEDs driven in response to signals from operational amplifier 706 by driver circuitry (not depicted) capable of driving the LEDs at varying levels of intensity.

Turning now to FIG. 7*b*, receiver 713 provides a high sensitivity phototransistor 714. No current needs to be supplied to the base of phototransistor 714. Rather, the current flowing through transistor 714 is varied by the intensity of modulated light signal 712 received by transistor 714, thereby demodulating amplitude intensity modulated signal 712. An exemplary phototransistor for this application is the FPT100 phototransistor from Fairchild Semiconductor Corporation of San Jose, Calif. By way of coupling through capacitor 716 and resistor 718, the varying current from transistor 714 is amplified by operational amplifier 720. Operational amplifier 720 in this embodiment is operated by dual power supplies 722, 724. An exemplary operational amplifier for this application is part number LM741 from National Semiconductor Corporation of Santa Clara, Calif. The demodulated signal, amplified by operational amplifier 720, is used to drive speaker 726, reproducing the sound that was originally modulated in light signal 712. In other embodiments in which content other than sound is transmitted, the output of operational amplifier 720, instead of driving speaker 726, provides input to an appropriate apparatus, such as a computing device, for rendering the communicated signal.

In the alternative, it will be understood that the dazzler LEDs may be employed for other forms of light propagated signaling, such as pulse modulated digital signaling, with appropriately designed receiver and transmitter electronics known to those of skill in the art.

Although the detailed descriptions above contain many specifics, these should not be construed as limiting the scope of the invention but as merely providing illustrations of some of the presently preferred embodiments of this invention. Various other embodiments and ramifications are possible within its scope.

While the invention has been described with a certain degree of particularity, it should be recognized that elements thereof may be altered by persons skilled in the art without departing from the spirit and scope of the invention. Further, while specific numbers and parameters have been set forth in keeping with the present state of the art, it will be understood that, if specifics of light emitting diode technology change over time, such numbers and parameters may be adjusted appropriately by persons of skill in the art and remain within the scope of the present invention. Accordingly, the present invention is not intended to be limited to the specific forms set forth herein, but on the contrary, it is intended to cover such alternatives, modifications and equivalents as can be reasonably included within the scope of the invention. The invention is limited only by the following claims and their equivalents.

We claim:

1. A hand held dazzler shield for protecting a user from a subject, comprising a shield surface having a user side and a subject side, the shield surface affording protection on the user side from objects originating on the subject side;

a plurality of light emitting diodes affixed to the shield surface forming an array for emitting directed beams of light outward from the subject side of the shield surface when the light emitting diodes are illuminated;

at least one driver in electrical communication with the light emitting diodes for providing current to cause the light emitting diodes to illuminate; and at least one means of defending the user from the subject.

2. A hand held dazzler shield according to claim 1, wherein the means of defending is selected from the group consisting of:

an integrated high intensity directed acoustical device, directed outward from the subject side of the shield;

electrical contacts affixed to the subject side of the shield, the contacts electrically connected to a power supply providing low amperage charge at a high voltage potential between contacts;

an integrated mechanism for aiming and propelling an electro-shock projectile at a subject, the projectile electrically connected to a power supply providing low amperage, high voltage charge;

an integrated means for dispersing a lacrymal agent toward a subject; and a plurality of sharp, elevated points on the subject side of the shield's surface.

3. A hand held dazzler shield according to claim 1, further comprising a glass breaker affixed to the shield.

4. A hand held dazzler shield according to claim 3, further comprising at least one handle affixed to the user side of the shield surface, the glass breaker affixed to the at least one handle.

5. A hand held dazzler shield according to claim 1, further comprising circuitry for modulating a signal to generate light propagated transmission of the signal from at least one of the light emitting diodes.

6. A hand held dazzler shield affording to claim 1, further comprising circuitry for demodulating light propagated signals incident upon the shield.

7. A hand held dazzler shield according to claim 1, further comprising:

a light propagated signal transmitter, comprising circuitry for modulating a signal to generate light propagated transmission of the signal from at least one of the light emitting diodes; and a light propagated signal receiver comprising circuitry for demodulating light propagated signals incident upon the shield.

8. A dazzler shield, comprising a shield surface having a user side and a target side, the shield surface affording protection on the user side from objects originating on the target side;

a plurality of light emitting diodes affixed to the shield surface forming an array for emitting directed beams of light outward from the target side of the shield surface when the light emitting diodes are illuminated;

at least one driver in electrical communication with the light emitting diodes for providing current to cause the light emitting diodes to illuminate; and at least one handle affixed to the user side of the shield surface.

9. A dazzler shield according to claim 8, further comprising a glass breaker attached to the shield.

10. A dazzler shield according to claim 9, wherein the glass breaker is attached to the at least one handle.

11. A dazzler shield according to claim 8, further comprising at least one of:

a light propagated signal transmitter, comprising circuitry for modulating a signal to generate light propagated transmission of the signal from at least one of the light emitting diodes; and a light propagated signal receiver comprising circuitry for demodulating light propagated signals incident upon the shield.

12. A dazzler shield according to claim 8, further comprising an arm strap.

* * * * *